US005456729A

United States Patent [19]

Villamagna et al.

[11] Patent Number: 5,456,729

[45] Date of Patent: Oct. 10, 1995

[54] SENSITIZER AND USE

[75] Inventors: Fortunato Villamagna, Slatington, Pa.; Arun K. Chattopadhyay, Brossard; Ming C. Lee, St. Hubert, both of Canada

[73] Assignee: ICI Canada Inc., Ontario, Canada

[21] Appl. No.: 866,023

[22] Filed: Apr. 9, 1992

[51] Int. Cl.[6] ..... C10L 9/00

[52] U.S. Cl. ..... 44/269; 44/270

[58] Field of Search ..... 44/270, 269

[56] References Cited

U.S. PATENT DOCUMENTS

| | | | |
|---|---|---|---|
| 3,447,978 | 6/1969 | Bluhm | 149/2 |
| 3,801,292 | 4/1974 | Tanner | 44/269 |
| 3,995,673 | 12/1976 | Grigaitis et al. | 149/21 |
| 4,525,225 | 6/1985 | Cechanski | 149/19.5 |
| 4,936,933 | 6/1990 | Yabsley et al. | 149/109.6 |

FOREIGN PATENT DOCUMENTS

| | | |
|---|---|---|
| 510416 | 11/1977 | Australia . |
| 0228354 | 7/1987 | European Pat. Off. . |
| 2052615 | 3/1971 | France . |
| 1813175 | 12/1968 | Germany . |
| 1270319 | 4/1972 | United Kingdom . |
| 2160857 | 1/1986 | United Kingdom . |

*Primary Examiner*—Peter A. Nelson
*Attorney, Agent, or Firm*—Charles Q. Buckwalter

[57] ABSTRACT

The present invention is directed to a sensitizer provided as a foam that may be used individually and/or added to explosives, propellants, and/or pyrotechnics.

5 Claims, No Drawings

SENSITIZER AND USE

BACKGROUND

The present invention is directed to the manufacture of a sensitizer that may be added to an explosive composition to provide sensitization and density reduction.

Void type sensitizers are known in this art to provide a hot spot for the initiation and propagation of detonation in explosives. A problem in this art is that sensitizers derived from microballoons known also as microbubbles are cost inefficient and open/closed cell voids such as perlite, volcanic ash, etc. are not as effective hot spot formers for initiation and propagation of explosive events. Chemical gassing such as nitrite or peroxide based systems form adequate bubbles for sensitization, however, these bubbles are susceptible to mechanical deterioration. Additionally, chemical gassing additives are functionally dependent upon and senitive to the temperature of the combined explosive components.

Combinations of chemical gassing sensitizers and microballoons are known in this art as disclosed in U.S. Pat. No. 5,017,251. Therein is disclosed the requirement for hybrid systems requiring chemically generated gases to enable a solution to the problem of hydrostatic and dynamic desensitization or shock resistance of the explosive.

In pending patent application, U.S. Ser. No. 07/892,900 filed on Apr. 9, 1992, a foam invention is disclosed. Said application is herein incorporated by reference in its entirety as filed.

The sensitizer disclosed herein is useful as a component in an explosive composition, as an explosive itself, as a propellant and/or a mixture thereof, and as a pyrotechnic or as a component in a pyrotechnic. The invention hereof can also be useful as a means to encapsulate and/or incorporate any gas species within an explosive, pyrotechnic, propellant and/or some combination thereof and/or therebetween. Additionally, the invention may be useful as a sensitizer carrier which may be bulk delivered and added to the explosive composition at any time prior to denotation.

SUMMARY OF THE INVENTION

In its most general aspects, the sensitizer is comprised of a single and/or a plurality of nonchemically generated gas and optionally chemical generated gas in liquid and/or solid phases providing a foamed product. The gas may be comprised of any gas generated by any means. Preferably, the gas is comprised of a highly soluble gas in the gas carrier liquid. Most preferably, the gas component is comprised of a gas that is soluble under morderate pressures and relatively insoluble at atmospheric pressures. Gases may be selected from the inert gases, chemically generated gases, gases condensed from air, low molecular weight high vapor pressure gas precursors, organic and/or inorganic gases, combinations thereof and therebetween. Preferably, the gas is selected from nitrogen, air, argon, oxygen, carbon dioxide, freons, propanes, pentanes, butanes, combinations thereof and/or therebetween. Most preferably, the gas is selected from nitrogen and/or air. Interestingly, when carbon dioxide is employed as the gas of choice, it creates a situation whereby the carbon dioxide may react with an ammonium nitrate component forming a stable complex that may then be available under certain conditions to self-foam and/or regenerate the foamed condition of the sensitizer. In another general aspect of the invention disclosed herein, it is simply a means of providing an explosive foam sensitizer product to an explosive composition at any time prior to detonation.

The amount of gas present in the sensitizer is a function of the stability of bubbles creating the foam and the density of the foam itself. This functionality reveals itself as a compromise between bubble size and thickness of the liquid and/or the continuous phase contiguous to the bubble, quantified as the density defined by the volume ratio of gas to the continuous phase. The density of the foam is useful from a range of about 1.5 to 0.01 grams per cubic centimeter dependent upon the composition of the continous phase. Preferably, the density of the foam is about 0.15 grams per cubic centimeter, most preferably the density of the foam is about 0.05 grams per cubic centimeter.

The foam can be stabilized with additives such as foaming agents, film formers, polymeric materials, surfactants, solid particulates, combinations thereof and/or therebewteen. Said additives may act through forces such as but not limited to electrostatic, hydrogen-bonding, steric interactions, van der Waals and/or some combination thereof and/or therebetween. Specific foaming agents are comprised of proteins such as milk proteins, animal protein, fish protein, protein derivatives, associated products such as lipoproteins, collagens, hydrolyzed proteins, chemically treated proteins and globulins. Steriods may also be used as foaming agents. Foaming agents include surfactants such as FC 740, FC 751, FC 100 (trademarks of the 3M Company), lanolin oil, derivatives of succinic anhydride, fatty acid derivatives, steryl octazylene phosphate, long chain alcohols, combinations thereof and/or therebetween. Polymeric materials are comprised of thermoplastics, natural and synthetic rubber, derivatives thereof and/or therebetween, polybutylenes and polybutenes, and tackifying agents such as paratack (from Exxon). Solid particulates such as carbon black, talc, and other particulate materials derived from any of the natural and/or synthetic ceramic materials such as minerals, silicates, aluminates, zirconates, oxides of the first, second, and/or third transition series of the Periodic Chart and other particulates capable of forming electrical double layers. The above additives generally comprise 1 to 99 weight percent of the foam, preferably 5 to 20 weight percent and most preferably 8 to 15 percent by weight.

The carrier liquid and/or continous phase is comprised of any liquid and/or solid which when combined with the gas bubble forms a continuous phase. Useful liquid carriers comprise any liquid wherein the foaming additives disclosed hereinabove can be dissolved and/or dispersed. Other carries comprise molten wax, molten trinitrotoluene (TNT), and/or any molten or liquid explosive material, combinations thereof and/or therebetween. Preferably, liquids are comprised of tall oil, mineral oil, waxes, paraffin oils, benezene, toluene, xylenes, mixtures of liquid hydrocarbons generally referred to as petroleum distillates, such as gasoline, kerosene, and diesel fuels. Most preferably, the carrier is comprised of a mineral and/or a fuel oil such as kaydol, klearol, Petro Canada HT-22, diesel oil number 2. Examples of continous solid phase components are ammonium nitrate, ammonium nitrate solution, solid melts, TNT, TNT RDX blends, TNT RDX ammonium perchlorate blends, perchlorates generally, and combinations thereof and/or therebetween. Ammonium nitrate is the preferred solid phase component.

The sensitizer may be advantageously combined with other explosive materials. Examples of such components are emulsions, emulsions and ammonium nitrate blends, emulsions and ANFO blends, slurried gel explosives, dynamites, combinations thereof and/or therebetween. Booster sensitive and cap sensitive explosives may advantageously be combined with the sensitizer of the present invention. The emulsions hereinabove may optionally be doped with additional components such as aluminum powder, ferrosilicon, TNT, PETN, methylamine nitrate, perchlorates, ethylenediaminedinitrate, and combinations thereof and/or therebetween. Generally, the sensitizer is present in an explosive combination from 1 to 99 volume percent of the explosive component. Preferably, 10 to 50 volume percent and most preferably 25 to 35 percent by volume for cap sensitive explosives and most preferably 10 to 25 volume percent for booster sensitive explosives.

Hybrid systems of nonchemically gas generated and microballoons may be foamed, combined as a sensitizer and added to any of the explosives disclosed hereinabove. Said hybrid systems may be added as a sensitizer consistent with the several uses of the present invention yielding advantageous results. The microballoons are comprised of glass spheres of various sizes and wall thicknesses and are combined with said nonchemically gas generated species in a volume ratio of from 1 to 99 and 99 to 1 volume percent, respectively. It is noted that chemically generated gas/microballoon hybrids are already available as disclosed in the above cited U.S. Pat. No. 5,017,251. Nonchemically generated gas/foam hybrids are not part of the prior art and are, therefore, part of the present invention.

The sensitizer may be used as an addition to propellants with advantageous results. Likely propellant candidates for sensitizer/propellant combinations are foamed TNT, foamed nitrocotton gel and/or slurry, foamed perchlorates, combinations thereof and/or therebetween.

Foam-life as defined herein is the ratio of foam volume at a given time versus the initial volume of the foam. Half-life of foam-life is defined as when approximately half of the original volume of foam remains as a function of time.

The method of incorporating the sensitizer into the other components may be by mechanical blending such as a ribbon blender, auger, screw feeder, and any other mechanical mixing means. Mixing may occur in-line with static and/or mechanical mixers, and may be mixed in a pump during the action of pumping the sensitizer to its ultimate end use. The sensitizer is manufactured by dissolving the gas under pressure in a liquid in a sealed container such as a high pressure vessel. Additionally, it has been found advantageous to mix the sensitizer components in a pressurized high shear mixer. It is not required that the mixer be pressurized, however, as those skilled in this art will recognize, the product and yield is greater and therefore preferred under a pressurized mixer system. The preferred means of pressurizing is by use of a gas sparger and tank stirrer to maximize dissolution rate. An in-line sparger or branch pipe may be used to make the foam product. Finally, an in-line static mixer may advantageously blend the gas and liquid to form the foam and combinations thereof. In the case of solid product, the mixing is done as a liquid which is then solidified after mixing.

It has been observed that when pumping emulsions and/or emulsion blends, such as blends with ammonium nitrate, with the sensitizer of the present invention pumping pressures are significantly decreased. Decreased pumping pressures aid in the delivery of said emulsions, making delivery safer and eliminating the need for a water-ring lubricating system.

DESCRIPTION OF THE PREFERRED EMBODIMENTS

The following examples are provided to better understand and illustrate how the invention hereof operates and are not intended to limit the scope of the invention disclosed herein.

Example 1

85 weight percent paraffin oil, 6 weight percent polyisobutylene, 6 weight percent lactic casein, 3 weight percent FC 740 were blended in a stir tank for about 12 hours at room temperature. The blend was mixed in a Votator continuous recycle mixer at 300 rpm with an air flow ratio of 10 to 1 gas to liquid. This provided a foam product with a density of about 0.10 grams per cubic centimeter. The foam product had a half-life as measured by the density of at least 30 to 40 minutes.

Example 2

Example 2 was made the same as Example 1 except that the polyisobutylene was omitted and that percentage replaced by oil. The half-life of Example 2 was at least 20 minutes.

Example 3

Example 3 was made the same as Example 1 except that No. 2 fuel oil was used in place of parafin oil. The half-life of Example 3 half-life was at least 20 minutes.

Example 4

Example 4 was similar to Example 1 except that FC 740 was used at a 2 weight percent level and the difference in weight percent made up by the addition of oil. Example 4 half-life was at least 30 minutes.

Example 5

Example 5 was an aqueous based system comprised of 69 weight percent water, 25 weight percent ammonium nitrate, 3 weight percent FC 751, and 3 weight percent lactic casein. This Example was mixed as in Example 1. The half-life was at least 30 minutes.

Example 6

Example 6 was an oil based system comprised of 91 weight percent vegatable oil, 3 weight percent FC 740, 6 weight percent soya lecithin mixed as in Example 1. The half-life was at least 20 minutes.

We claim:

1. A sensitizer comprised of a single and/or plurality of nonchemically generated gas and optionally chemically generated gas in liquid and/or solid phases providing a foam of reduced density wherein said density is about 0.01 to less than 1.0 grams per cubic centimeters wherein said sensitizer is in combination with a single and/or plurality of explosive materials.

2. The foam of claim 1 wherein said foam is stabilized with stabilizing agents selected from the group consisting of foaming agents, film formers, polymeric materials, surfactants, solid particulates, combinations thereof and/or therebetween.

3. The stabilizing agents of claim 2 wherein said stabilizing agents are selected from the group consisting of milk proteins, animal proteins, fish proteins, protein derivatives, lipoproteins, collagens, hydrolyzed proteins, chemically treated proteins and globulins, steriods, FC 740, FC 751, FC 100, lanolin oil, deriviatives of succinic anhydride, fatty acid derivatives, steryl octazylene phosphate, long chain alcohols, thermoplastics, natural and synthetic rubbers, polybutylenes, polybutenes, paratack, silicates, aluminates, zirconates, oxides of the first, second, and third transition series of the Periodic Chart, combinations thereof and/or therebetween.

4. The stabilizing agents of claim 3 wherein said stabilizing agents comprise 5 to 20 weight percent of said combination.

5. The stabilizing agents of claim 3 wherein said stabilizing agents comprise 8 to 15 weight percent of said combination.

* * * * *